United States Patent [19]

Nariyama

[11] Patent Number: 5,022,365

[45] Date of Patent: Jun. 11, 1991

[54] ACCESSORY DRIVE ARRANGEMENT FOR V-TYPE ENGINE

[75] Inventor: Yoshihiro Nariyama, Iwata, Japan

[73] Assignee: Yamaha Hatsudoki Kabushiki Kaisha, Iwata, Japan

[21] Appl. No.: 400,495

[22] Filed: Aug. 30, 1989

[30] Foreign Application Priority Data

Aug. 31, 1988 [JP] Japan ..... 63-219495

[51] Int. Cl.[5] ..... F02B 77/00

[52] U.S. Cl. ..... 123/198 R; 123/90.27

[58] Field of Search ..... 123/90.31, 56 AA, 56 BA, 123/55 VF, 55 VS, 55 VE, 195 R, 195 A, 195 C, 198 E, 90.27

[56] References Cited

U.S. PATENT DOCUMENTS 4,125,036 11/1978 Nakamura et al. ..... 123/195 A
4,643,143 2/1987 Uchiyama et al. ..... 123/90.27

FOREIGN PATENT DOCUMENTS 55-142936 11/1980 Japan ..... 123/55 VF
61-255249 11/1986 Japan ..... 123/195 C

*Primary Examiner*—Noah P. Kamen
*Attorney, Agent, or Firm*—Ernest A. Beutler

[57] ABSTRACT

An improved arrangement for a V-type of engine having staggered cylinder banks wherein an accessory is driven by the engine and is located at least in part within the void defined by the stagger between the cylinder banks.

6 Claims, 4 Drawing Sheets

11
13
14
Fr
12
3
16
17
15
18
19
56
22
35
38
29
14
21
2
2
42
41
43
34
59
39
13
3

35

18
29
31
32
34
16
22
38
47
39
46
47
52
4
4
51
53
49
57
55
57
54
58
10
58
45
45
61
55
59
56
57
58
44
58
57
17

ACCESSORY DRIVE ARRANGEMENT FOR V-TYPE ENGINE

BACKGROUND OF THE INVENTION

This invention relates to an accessory drive arrangement for an engine having banks of cylinders and more particularly to an engine having staggered banks of cylinders arranged in a V pattern.

As is well known, the complexity of modern internal combustion engines is becoming quite great. In addition, the engine is called upon to drive a wide variety of accessories, particularly in automotive applications. Because of the complexity of the engine and the number of accessories driven, the package size of the engine and its accessories can become quite large. This is particularly disadvantageous with modern motor vehicles wherein the engine compartment does not offer large areas for engine and accessory placement.

It is, therefore, a principal object of this invention to provide an improved compact accessory drive arrangement for an internal combustion engine.

It is a further object of this invention to provide a compact accessory drive arrangement for an internal combustion engine having banks of cylinders wherein the accessories will not significantly add to the engine package size.

SUMMARY OF THE INVENTION

This invention is adapted to embodied in an internal combustion engine having banks of cylinders disposed at an angle to each other. One of the banks is staggered relative to the other of the banks so that one end of the one bank is spaced from a plane containing the corresponding end of the other bank. An accessory for the engine is positioned externally thereof and in the area ahead of the one end of the one cylinder bank and extending beyond the plane toward the one end so as to be located in the staggered area of the engine. Means drive the accessory from the engine.

DETAILED DESCRIPTION OF THE PREFERRED EMBODIMENT OF THE INVENTION

Figure 1:
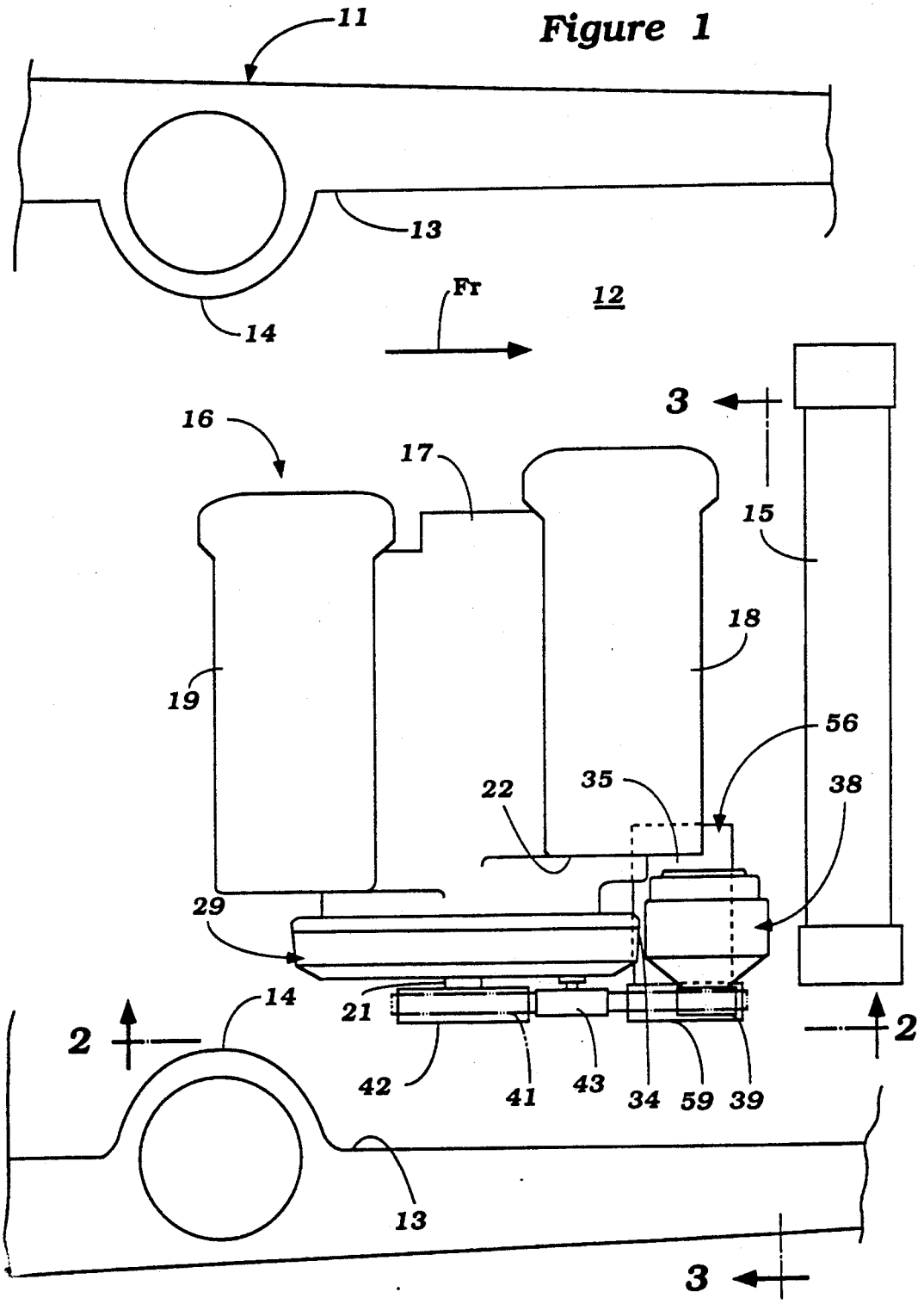
FIG. 1 is a top plan view of a portion of a motor vehicle showing its engine compartment containing an engine and accessories driven thereby constructed in accordance with an embodiment of the invention.
Figure 2:
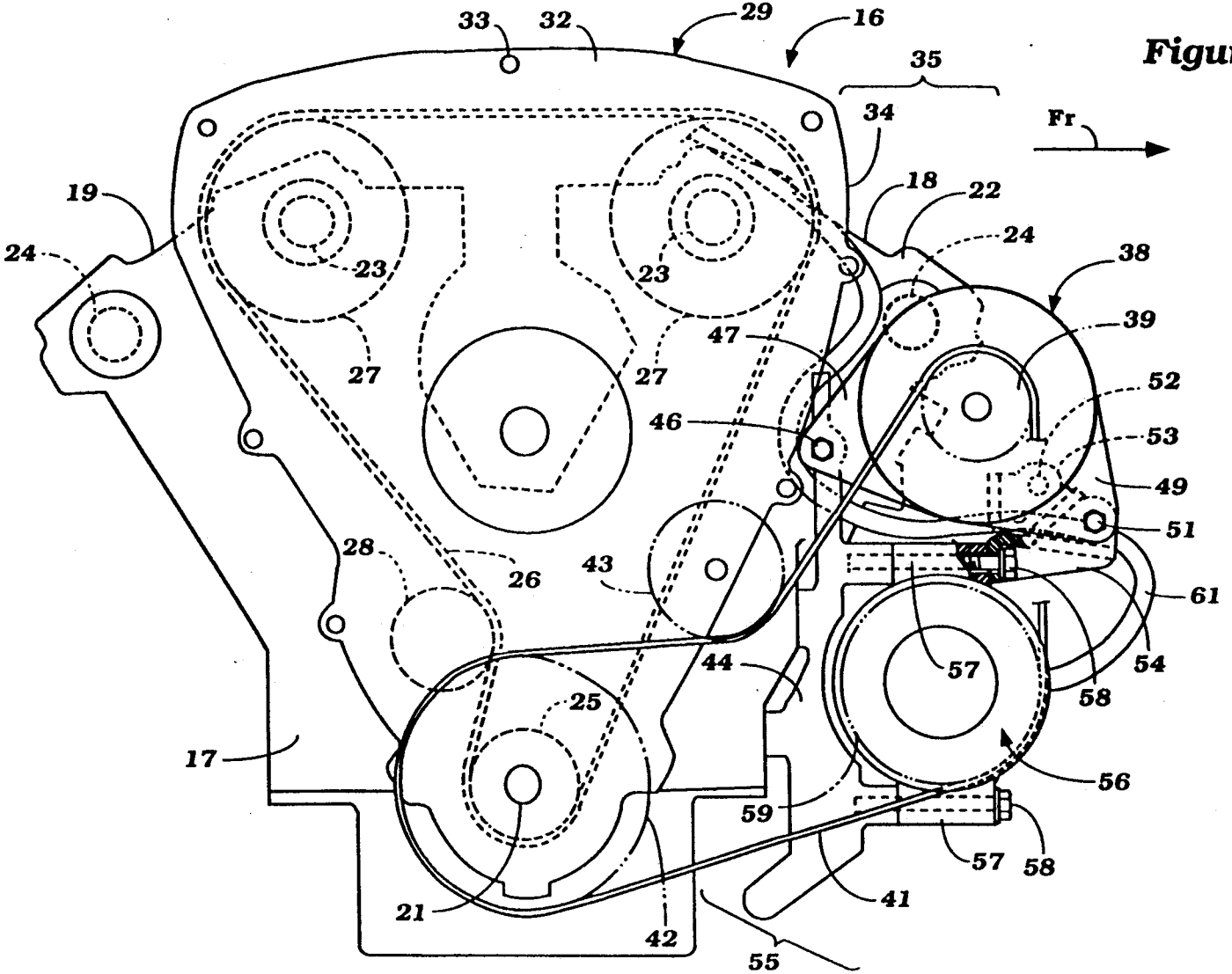
FIG. 2 is an enlarged end elevational view of the engine looking in the direction of the line 2—2 of FIG. 1.
Figure 3:
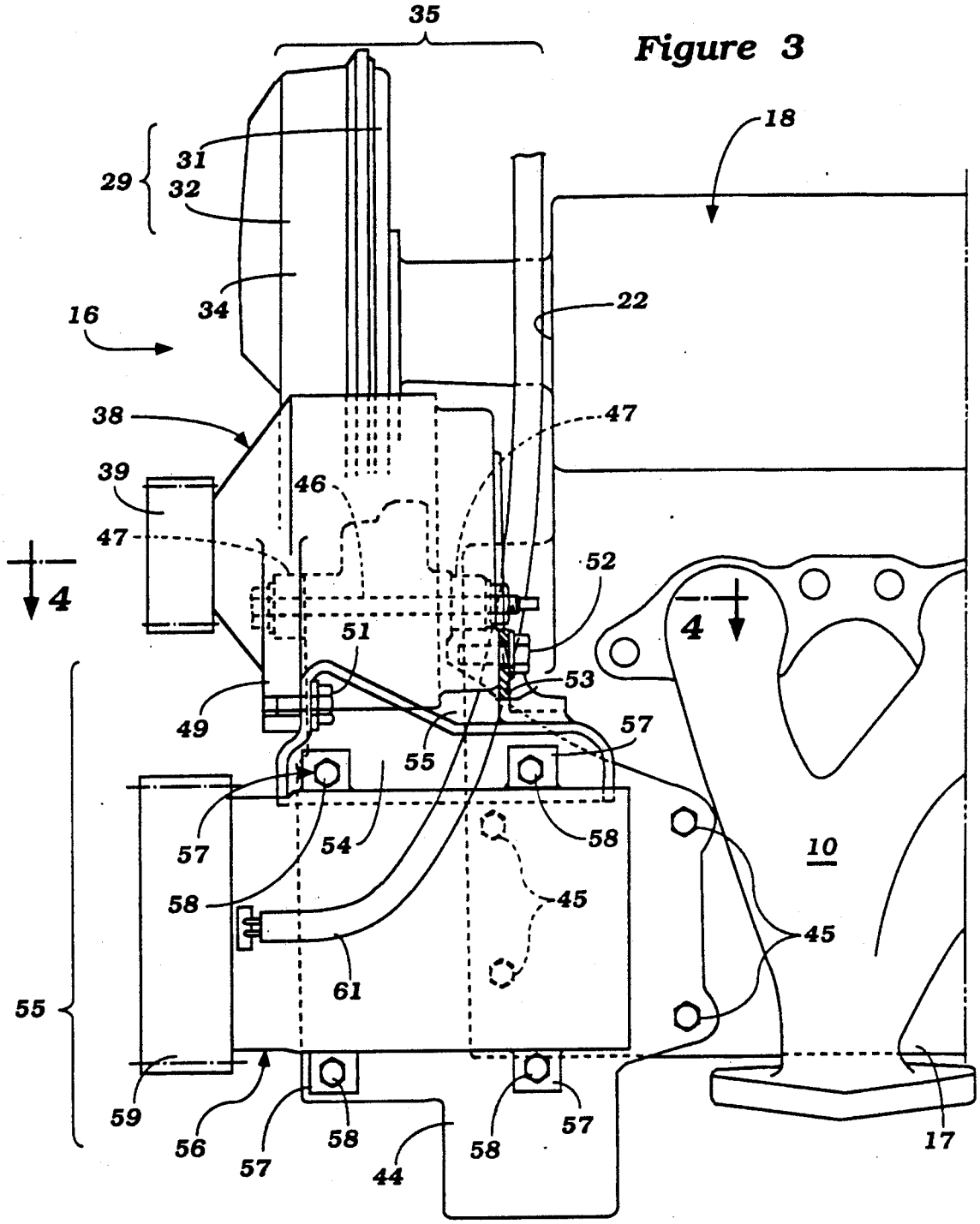
FIG. 3 is an enlarged partial side elevational view of the engine looking in the direction of the line 3—3 in FIG. 1.
Figure 4:
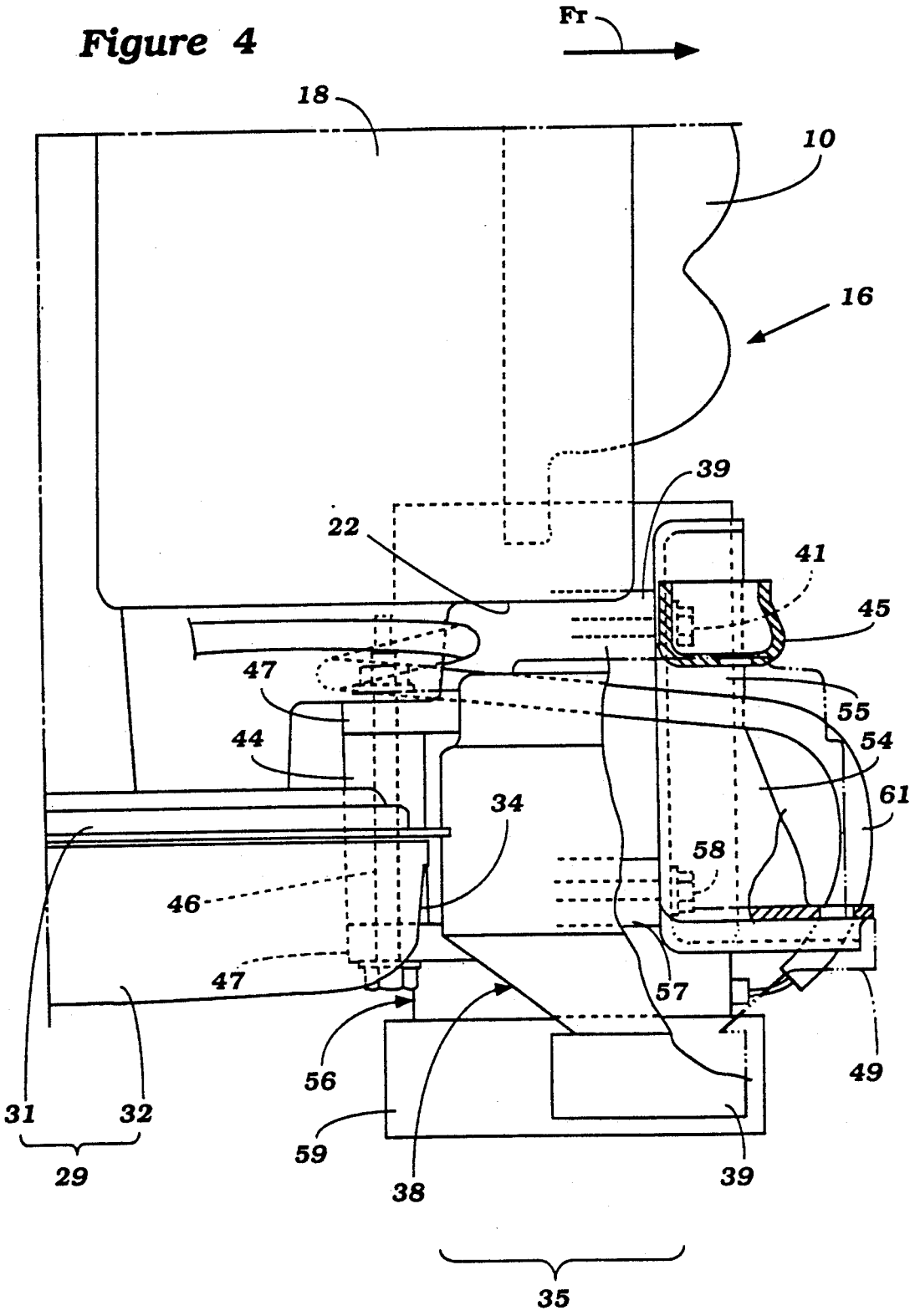
FIG. 4 is a view taken generally in the direction of the line 4—4 of FIG. 3 and shows portions in section.

Referring now in detail to the drawings and initially to FIG. 1, a motor vehicle powered by an internal combustion engine constructed in accordance with an embodiment of the invention is identified generally by the reference numeral 11. Only a portion of the vehicle 11 is depicted, this portion being the forward part that defines the engine compartment 12 between a pair of wheel wells 13 in which front suspension struts 14 mounted in a known manner. A grill opening (not shown) is positioned forwardly of the engine compartment 12 (in the direction indicated by the arrow Fr) and a radiator 15 is disposed transversely across the forward portion of the engine compartment 12 rearwardly of this grill opening.

Positioned within the engine compartment 12 partially between the front suspension struts 14 and between the fender wells 13 rearwardly of the radiator 15 is a transversely disposed V-type internal combustion engine constructed in accordance with an embodiment of this invention and identified generally by the reference numeral 16. The invention is described in conjunction with a V-type engine which may have any number of cylinders, such as six in the depicted embodiment. The invention can be utilized in conjunction with engines having cylinder banks disposed other than in a V arrangement. However, the invention has particular utility in conjunction with engines wherein the cylinder banks of the engine are staggered, as will be described.

The engine 16 is comprised of a cylinder block 17 that is provided with a pair of angularly disposed cylinder, banks to which respective cylinder heads 18 and 19 are affixed in a known manner. Cylinder bores are formed within the cylinder banks and slidably support pistons that are connected by means of connecting rods to drive a crankshaft 21 that is journaled for rotation about an axis that extends transversely to the engine compartment 12 as is typical in front engine front wheel drive arrangements or rear engine rear wheel drive arrangements. Although the invention is described in conjunction with such an engine placement, it is to be understood that the invention may be practiced in conjunction with more traditional front to rear engine orientations.

Referring now additionally to the remaining figures, it should be noted that the engine 16 is disposed so that its cylinder banks are staggered slightly relative to each other. That is, the front face of the cylinder bank with which the cylinder head 19 is associated lies in a plane that is displaced forwardly relative to the front face 22 of the cylinder bank with which the cylinder head 18 is associated. This is conventionally done in connection with V-type engines so that the connecting rods associated with adjacent cylinders of the respective banks can be journaled on the same throw of the crankshaft 21. This internal construction of the engine is believed to be well known to those skilled in the art. For that reason, a detailed description is not believed to be required.

In the illustrated embodiment, the engine 16 is depicted as being of the twin overhead camshaft type with intake camshafts 23 and exhaust camshafts 24 being journaled in the respective cylinder heads 18 and 19. The intake camshafts 23 are disposed toward the valley of the V while the exhaust camshafts 18 are disposed outwardly therefrom. Although the invention is described in conjunction with a twin overhead camshaft arrangement, it can be practiced with single overhead camshaft engines or, in fact, engines in which the camshafts are not mounted in the cylinder heads 18 and 19.

The camshafts 23 and 24 are driven from the crankshaft 21 in a manner as described in U.S. Pat. No. 4,643,143, Valve Driving Means For V-type Engine Of Vehicle, issued Feb. 17, 1987, which patent is assigned to the assignee of this application. That disclosure is incorporated by reference and generally includes a driving sprocket 25 that is affixed to the forward end of the crankshaft 21 and which drives a toothed timing belt 26. The timing belt 26 is engaged with driven sprockets 27 affixed to the ends of the intake camshafts 23 and is tensioned by means of an idler tensioner pulley 28. This belt driving mechanism is contained within a belt casing, indicated generally by the reference numeral 29 and which is located at the front end of the engine. The belt casing 29 is comprised of a pair of interfitting parts 31 and 32 that are held together by means of a plurality of fasteners 33 in a known manner. It should be noted that the belt casing 29 is disposed forwardly of both ends of the cylinder banks associated with the cylinder heads 18 and 19 but is further ahead of the front face 22 of the cylinder bank associated with the cylinder head 18.

As described in aforenoted U.S. Pat. No. 4,643,143, the exhaust camshafts 24 of each cylinder head 18 and 19 are driven from the intake camshafts 23 by a respective flexible transmitter (not shown).

As may be readily apparent from FIG. 1, the engine compartment 12 does not offer a large amount of space for the engine 16 and the accessories, to be described, which are driven by it. In accordance with the invention, however, the stagger between the cylinder banks is utilized as a space in which the accessories or at least certain of them may be mounted so as to permit a compact assembly. It will be noted that the belt casing 29 has an outer peripheral surface 34 that defines a recess or open area 35 that extends forwardly of the cylinder bank with which the head 18 is associated (the staggered bank) and to one side of the belt casing 29. In accordance with the invention, an accessory such as an alternator or generator, indicated generally by the reference numeral 38, is positioned so that it extends at least in part into this area 35. The alternator 38 has an input or driving shaft to which a driven pulley 39 is affixed. The pulley 39 is driven from a belt 41 which is, in turn, driven by a pulley 42 that is affixed to the crankshaft 21 forwardly of the belt casing 29. An idler pulley 43 engages the belt 41 and may be employed to tension it.

The alternator 38 is mounted to the engine 16 by means of a mounting bracket 44 that is affixed to the cylinder block 17 by means of a plurality of fasteners 45. The mounting bracket 38 receives a pivot bolt 46 that passes through a flange 47 on the housing of the alternator 39 so as to pivotally support the alternator 38 on the bracket 44. The pivotal movement of the alternator 38 around the pivot bolt 46 may be employed for achieving the proper tension in the belt 41 in a known manner. The alternator housing further has an ear portion 48 that receives a further threaded fastener 51 for locking the alternator 38 in the adjusted angular position. A further locking bolt 52 cooperates with a flange 53 of a bracket 54, which is mounted in a manner to be described, for retaining the position of the alternator 38.

Beneath the area 35 wherein the alternator 38 is partially mounted, there is a further free space indicated by the area 55 in which an air conditioning compressor, indicated generally by the reference numeral 56, is positioned. The air conditioning compressor 56 has an outer housing that is formed with a plurality of bosses 57 through which mounting bolts 58 pass. The mounting bolts 58 are threaded into the mounting bracket 44 and the upper ones of them serve to hold the mounting bracket 54 in position. A drive sprocket and electrically operated clutch assembly 59 is engaged by the belt 41 and is coupled, when the clutch is engaged, to the input shaft of the compressor 56 so as to drive it. The compressor has return and output lines, one of which is indicated at 61, that deliver refrigerant to the air conditioning system and return it to the compressor 56 from this system. Since the air conditioning system, except for the mounting to the air conditioning compressor, forms no part of the invention and may be conventional, further discussion of it is not believed to be necessary.

It should be readily apparent from the foregoing description that a very compact and highly effective driving arrangement has been provided for an accessory of an internal combustion engine. In accordance with the invention, the accessory is at least partially contained within a void formed by the stagger of one of the cylinder banks and hence does not significantly increase the engine package size. It is to be understood that the foregoing description is that of a preferred embodiment of the invention and that various changes and modifications may be made without departing from the spirit and scope of the invention, as defined by the appended claims.

I claim:

1. In an internal combustion engine having a crankcase, banks of cylinders connected to said crankcase and disposed at an angle to each other, one of said banks being staggered relative to the other of said banks so that one end of said one bank is spaced from a plane containing the corresponding end of the other of said banks, at least one camshaft associated with each cylinder banks, driving means at the one end of said engine for driving said camshafts from said engine, a first accessory for said engine positioned externally thereof an in the area ahead of said one end of said one cylinder bank and extending beyond said plane toward said one end to be located in the staggered area of said engine, a secondary accessory positioned beneath said one cylinder bank and adjacent said crankcase, and means for driving said accessories from said engine.

2. In an internal combustion engine as set forth in claim 1 wherein the means for driving the accessories drives the accessories from the one end of the engine.

3. In an internal combustion engine as set forth in claim 2 wherein the means for driving the accessories comprises a single drive belt.

4. In an internal combustion engine as set forth in claim 2 wherein the means for driving the accessory from the engine is located forwardly of the protective casing.

5. In an internal combustion engine as set forth in claim 1 further including a protective casing for the driving means enclosing at least in part said driving means.

6. In an internal combustion engine as set forth in claim 1 wherein the second accessory extends beyond the one end of the one cylinder bank.

* * * * *